US005131120A

United States Patent [19]

Akashi

[11] Patent Number: 5,131,120

[45] Date of Patent: Jul. 21, 1992

[54] SEPARABLE BOTTOM END ASSEMBLY FOR SLIDE FASTENER

[75] Inventor: Shunji Akashi, Toyama, Japan

[73] Assignee: Yoshida Kogyo K.K., Tokyo, Japan

[21] Appl. No.: 813,348

[22] Filed: Dec. 23, 1991

[30] Foreign Application Priority Data

Dec. 27, 1990 [JP] Japan ..... 2-416829

[51] Int. Cl.[5] ..... A44B 19/38

[52] U.S. Cl. ..... 24/433; 24/388; 24/434

[58] Field of Search ..... 24/433, 434, 435, 420, 24/419, 429, 430, 388, 390

[56] References Cited

U.S. PATENT DOCUMENTS 2,640,255 6/1953 Morrow ..... 24/433
4,742,603 5/1988 Kasai ..... 24/433
4,976,016 12/1990 Takabatake ..... 24/433
5,007,145 4/1991 Kim ..... 24/433
5,025,535 6/1991 Kusayama ..... 24/433

*Primary Examiner*—Victor N. Sakran
*Attorney, Agent, or Firm*—Hill, Van Santen, Steadman & Simpson

[57] ABSTRACT

In a separable bottom end assembly for a slide fastener, a socket member includes an outer box in which a first separate pin member is received so as to project upwardly therefrom, an inner box received in the outer box, and springs mounted between the outer box and the first separate pin member so as to normally urge the inner box upwardly. The inner box has a hollow portion through which a second separate pin member is inserted. The outer box has on its outer surface a locking projection which is lockingly engageable with a pull tab of a slider when the inner box is pushed downwardly against the bias of the springs by the slider.

2 Claims, 4 Drawing Sheets

SEPARABLE BOTTOM END ASSEMBLY FOR SLIDE FASTENER

BACKGROUND OF THE INVENTION

1. Field of the Invention

This invention relates to a separable bottom end assembly adapted to be attached to bottom end portions of a pair of fastener stringers of slide faster for separably connecting the two fastener stringers with one another.

2. Description of the Related Art

A typical conventional type of separable bottom end assembly for a slide fastener comprises a socket member attached to the bottom end portion of one fastener stringer and having a first pin member integral with the socket member, and a second pin member attached to the bottom end portion of the other fastener stringer. For connecting the separated fastener stringers with one another, with a slider kept in contact with the socket member, the second pin member is inserted deeply into the socket member through the slider, whereupon the slider is moved upwardly with the second pin member kept in this inserted position. During that time, the slider must be pulled upwardly away from the socket member by one hand of the user, while the socket member and the second pin member must be held in a coupled status by the other hand. For separating the interconnected fastener stringers from one another, the second pin member must be removed from the socket member by one hand, with the slider held in contact with the socket member by the other hand. It is therefore difficult for a little child, an old person or a handicapped person to perform this two-hand operation.

A solution for the foregoing problem is disclosed in, for example, Japanese Utility Model Publication No. 7845/1970. In the arrangement of this Japanese publication, the pull tab has a small projection, and the socket member has a hole in which the projection is engageable to hold the slider against the socket member in such a manner that the groove of the slider is aligned with the groove of the socket.

With this prior art, since the slider and the socket member are coupled with one another by the projection-and-hole connection, the second pin member can be inserted into the socket member through the slider only by one hand. However, at the beginning of closing the slide fastener by pulling the slider upwardly, after the second pin member is inserted, to close the slide fastener, the second pin member would often be lifted and removed from the socket member in response to the upward movement of the slider. Particularly, in the case of a jumper, since pulling forces act on the second pin member and the socket member in such a manner that these two members are moved away from each other, the second pin member inserted in the socket member would be lifted from the socket member at the beginning of closing operation of the slider. Therefore, smooth closing of the slide fastener cannot always be guaranteed.

SUMMARY OF THE INVENTION

It is therefore an object of this invention to provide a separable bottom end assembly, for a slide fastener, with which a pair of fastener stringers can be correctly connected with and separated from one another simply by one hand.

According to this invention, there is provided a separable bottom end assembly for a slide fastener including a pair of fastener stringers and a slider threaded on the fastener stringers, each of the fastener stringers having a row of coupling elements, the assembly comprising: a socket member attached to a bottom end portion of one of the fastener stringers and having a first separate pin member; a second separate pin member attached to a bottom end portion of the other fastener stringer and adapted to be inserted into the socket member through the slider, the second separate pin member having an engaging projection engageable with a lowermost coupling element of the one fastener stringer; and the socket member including an outer box in which the first separate pin member is received so as to project upwardly therefrom, an inner box received in the outer box, and at least one spring mounted between the outer box and the first separate pin member so as to normally urge the inner box upwardly, the inner box having a hollow portion through which the second separate pin member is inserted, the outer box having on its outer surface a locking projection adapted to lockingly engage a pull tab of the slider when the inner box is pushed downwardly against the bias of the spring by the slider.

In operation, when connecting the separated fastener stringers, the pull tab of the slider is brought into engagement with the locking projection of the outer box with the slider is pushed against the inner box against the bias of the spring, and then the second pin member is inserted into the hollow portion of the inner box through the slider, whereupon the pull tab of the slider is released from the locking projection of the outer box. In response to this releasing, the inner box is moved upwardly by the resilience of the spring so that the second pin member inserted in the inner box is brought toward the first pin member and assumes a posture parallel thereto, at which time the engaging projection of the second pin member is brought into engagement with the lowermost coupling element of the companion fastener stringer. Since the slider is pulled upwardly with the second pin member kept from removing the socket member, smooth and correct closing operation of the slide faster can be achieved.

When separating the interconnected fastener stringers, the pull tab of the slider is brought into engagement with the locking projection with the slider pushed against the inner box in the above-mentioned manner, whereupon the second pin member is removed from the inner box. Since the engaging projection of the second pin member would be inclined so as to disengaged from the lowermost coupling element of the companion fastener stringer, the second pin member can be removed from the socket member smoothly.

DETAILED DESCRIPTION

A separable bottom end assembly according to one embodiment of this invention will now be described with reference to the accompanying drawings.

Figure 1:
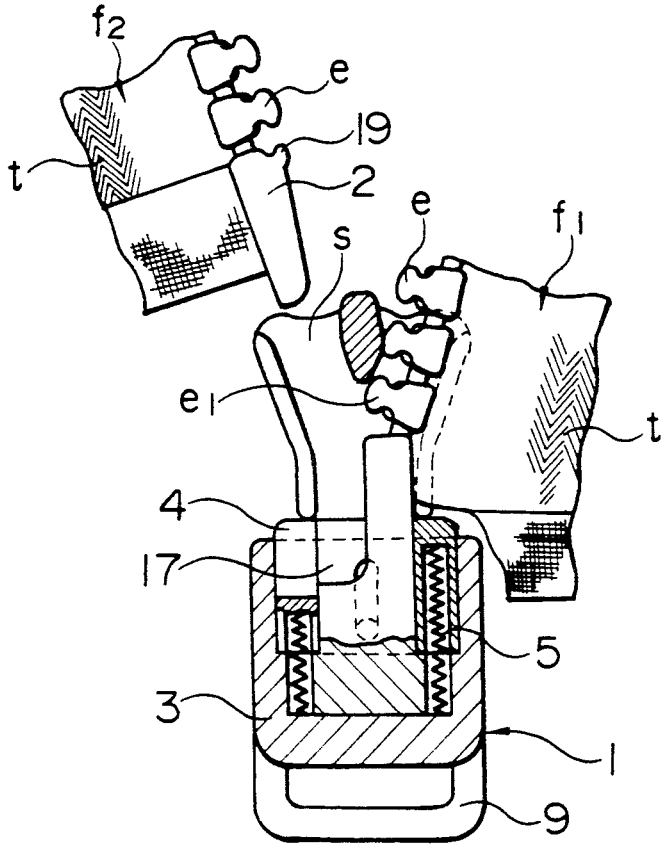
FIG. 1 is a front view, with parts broken away, of a separable bottom end assembly, of this invention, attached to a slide fastener, showing a pair of fastener stringers separated from one another.

As shown in FIG. 1, the separable bottom end assembly generally comprises a socket member 1 and a separate pin member (hereinafter called "second pin member") 2.

Figure 3:
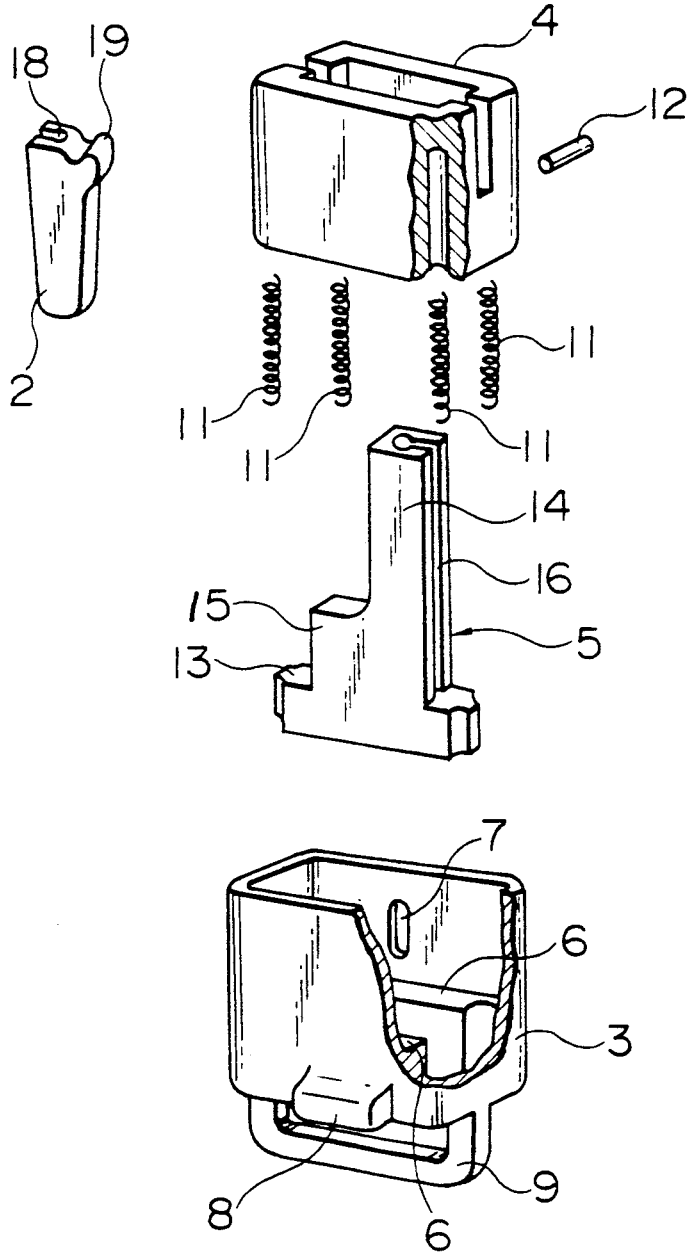
FIG. 3 is an exploded perspective view, with parts broken away, of the separable bottom end assembly.

The socket member 1, as shown in FIG. 3, includes an outer box 3, an inner box 4 and an intermediate part 5. The outer box 3 is an upwardly open box having a pair of opposed stepped portions 6, 6 projecting respectively from a pair of confronting inner side walls. One of the confronting side walls has at its upper portion a vertically extending guide hole 7, and the other side wall has on its outer surface a locking projection 8 extending from a lower portion of the outer surface and on its bottom surface a looped portion 9 for a purpose described below. The inner box 4 is an upwardly and downwardly open rectangular tube having at each corner a blind hole 10 extending upwardly from the bottom and terminating short of the top. The inner box 4 is received in the outer box 3 above the two stepped portions 6, 6 has such a size as to project slightly from the top of the outer box 3. A spring 11 is received in each of the blind hole 10, acting on the outer and inner boxes 3, 4 to normally urge the inner box 4 upwardly. The inner box 4 also has on its outer surface a pin 12 received in the guide hole 7 of the outer box 3. The intermediate part 5 has a base 13 received between the two stepped portions 6, 6 of the outer box 3, a separate pin member (hereinafter called "first pin member") 14 extending vertically upwardly from the center of the base 13 through the inner box 4, and a guide portion 15 extending vertically upwardly from the base 13 into the inner box 4 and shorter than the first pin member 14. Thus the intermediate part 5 has a generally L-shaped contour. The first pin member 14 has on its rear surface a vertical groove 16 for receiving the tape t of one fastener stringer f1 of a slide fastener. The intermediate part 5 is fixedly mounted in the outer box 3 by means of rivets, adhesive, etc. As thus assembled, there is defined a hollow portion 17 in the inner box 4 above the guide portion 15 for receiving the second pin member 2.

The second pin member 2 is a generally rectangular stick having in one surface a vertical groove 18 for receiving the tape t of the other fastener stringer f2. The second pin member 2 also has an engaging projection 19 extending from an upper portion of the other surface, for a purpose described below. The second pin member 2 is vertical at the upper portion of the other surface and is inclined at the lower portion so as to taper to the lower end.

For assembly, the first pin member 14 and the second pin member 2 are attached to the respective fastener stringer f1, f2 contiguously to the respective lowermost coupling elements e, e, as shown in FIG. 1. At that time, the inner edges of the opposite fastener tapes t, t are inserted respectively through the groove 16 of the first pin member 14 and the groove 18 of the second pin member 2 and are fixedly attached thereto by caulking, if these pin members 14, 2 are made of metal, or by injection molding, if they are made of synthetic resin. The inner box 4 of the socket member 1 is normally urged upwardly by the resilience of the springs 11 and is prevented, by the pin 12 inserted in the guide hole 7 of the outer box 3, from being removed from the outer box 3. By the first pin member 14 and the guide portion 15, the inner box 4 can be guided perpendicularly in either the upward or the downward direction.

Figure 2:
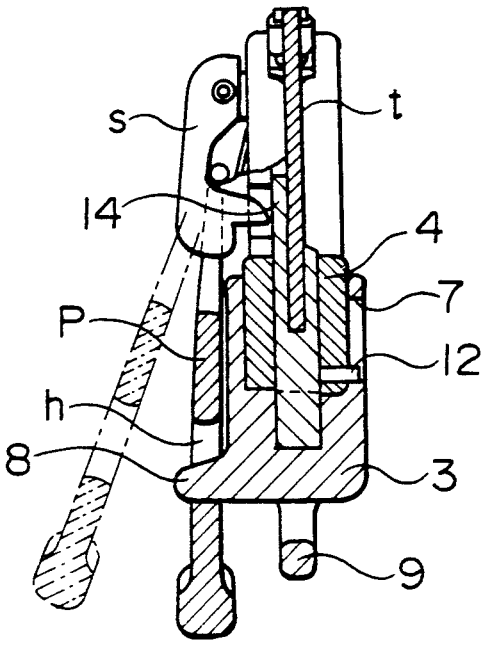
FIG. 2 is a side view, with parts broken away, of FIG. 1, showing how the slider is locked on a socket member.

As shown in FIG. 2, the locking projection 8 formed on the outer box 3 is engageable in an opening h of a pull tab p of a slider s when the inner box 4 is pushed downwardly against the bias of the springs 11 by the slider s until the inner box 4 contacts the stepped portions 6, 6 of the outer box 3. The form of the locking projection 8 depends on the form of the pull tab p of the slider s; for example, if the pull tab p has a projection (not shown) on the rear surface, the locking projection 8 should be substituted by a recess (not shown) for lockingly receiving the projection.

Figure 4:
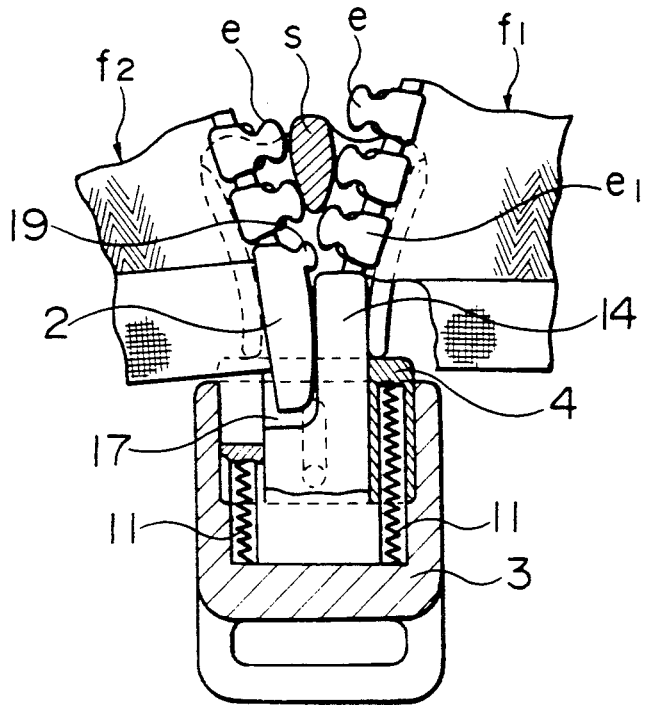
FIG. 4 is a front view, with parts broken away, of the separable bottom end assembly with a second pin member inserted into the socket member through the slider locked on the socket member.
Figure 6:
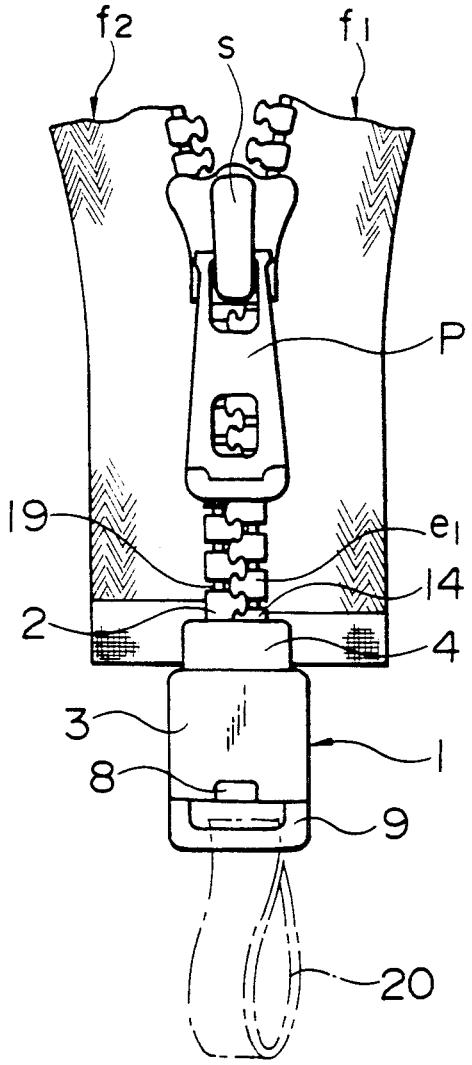
FIG. 6 is a fragmentary front view of a slide fastener to which the separable bottom end assembly of this invention is attached, showing a pair of fastener stringers partially closed.

As shown in FIG. 4, when inserted into the inner box 4 through the slider s with the inner box 4 pushed to the lowermost position, the second pin member 2 assumes in a slightly inclined posture, and the inclined surface of the second pin member 2 comes in contact with the first pin member 14 while a part of the rear surface of the second pin member 1 comes in contact with one of a pair of guide flanges of the slider s. Therefore the second pin member 2 is prevented from being further inserted into the inner box 4. To the looped portion 9 formed on the bottom surface of the outer box 3, a connector 20 such as a hook or a looped band may be attached, as shown in FIG. 6.

Figure 5:
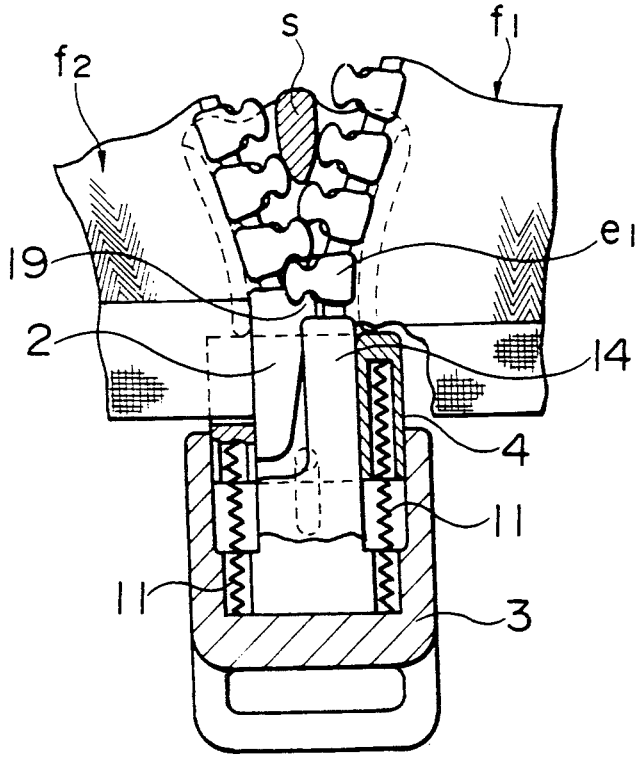
FIG. 5 is a view similar to FIG. 4, showing the separable bottom end assembly with the slider released from the socket member.

For interconnecting the separated fastener stringers f1, f2 as shown in FIG. 1, the slider s is pulled downwardly all the way along the fastener stringer f1, pushing the floating inner box 4 downwardly, whereupon the locking projection 8 is brought into engagement with the opening h of the slider pull tab p to hold the inner box 4 in depressed position and the slider s in contact with the socket box 1. In this status, the second pin member 2 is inserted into the hollow portion 17 from the front side of the slider s as shown in FIG. 4, and the slider pull tab p is released from the locking projection 8 as indicated by phantom lines in FIG. 2. In response to this releasing, the inner box 4 rises automatically under the resilience of the springs 11, as shown in FIG. 5, so that the inclined second pin member 2 is moved so as to assume an upright posture, thus bringing the engaging projection 19 of the second pin member 2 into engagement with the lowermost coupling element e1 of the companion fastener stringer f1. Then the slider s is pulled upwardly to close the opposite fastener stringers f1, f2. As a result, the two fastener stringers f1, f2 have been interconnected. At that time, if the connector 20 (FIG. 6) is hooked on a fixed thing nearby the user, a smooth closing operation of the slider s can be guaranteed.

For separating the interconnected fastener stringers f1, f2 from one another, the slider s is pulled downwardly to depress the inner box 4 as shown FIGS. 1 and 2, and then the slider pull tab p is released from the locking projection 8 of the outer box 3, whereupon the second pin member 2 is removed from the socket member 1. As a result, the two fastener stringers f1, f2 have been separated from one another.

With the separate bottom end assembly of this invention, since when interconnecting and separating the opposite fastener stringers with and from one another, the inner box is depressed into the outer box against the bias of the springs by the slider, and the slider is fixedly secured to the outer box to hold the inner box in this depressed position, the inner box rises automatically under the resilience of the springs to bring the engaging projection of the second pin member into engagement of the lowermost coupling element of the companion stringer so that the slide fastener can be properly closed simply by one hand and also so that the opposite fastener stringers can be separated simply by one hand.

What is claimed is:

1. A separable bottom end assembly for a slide fastener including a pair of fastener stringers and a slider threaded on the fastener stringers, each of the fastener stringers having a row of coupling elements, said assembly comprising:

(a) a socket member attached to a bottom end portion of one of the fastener stringers and having a first separate pin member;

(b) a second separate pin member attached to a bottom end portion of the other fastener stringer and adapted to be inserted into said socket member through the slider, said second separate pin member having an engaging projection engageable with a lowermost coupling element of said one fastener stringer; and (c) said socket member including an outer box in which said first separate pin member is received so as to project upwardly therefrom, an inner box received in said outer box, and at least one spring mounted between said outer box and said first separate pin member so as to normally urge said inner box upwardly, said inner box having a hollow portion through which said second separate pin member is inserted, said outer box having, on its outer surface, means for locking a pull tab of the slider when said inner box is pushed downwardly against the bias of said spring by the slider.

2. A separable bottom end assembly according to claim 1, wherein said locking means is a locking projection adapted to lockingly engage in an opening of the pull tab of the slider.

* * * * *